US005105636A

United States Patent [19]

Anastase et al.

[11] Patent Number: 5,105,636

[45] Date of Patent: Apr. 21, 1992

[54] BEARING AND SEAL SYSTEM FOR FABRIC TREATMENT MACHINES

[75] Inventors: Constantin Anastase; Robert J. Guiterrez, both of Wichita Falls, Tex.; Debbie Hudson, Holloman AFB, N. Mex.

[73] Assignee: White Consolidated Industries, Inc., Cleveland, Ohio

[21] Appl. No.: 637,311

[22] Filed: Jan. 3, 1991

[51] Int. Cl.[5] ..... D06F 37/22

[52] U.S. Cl. ..... 68/140; 68/208; 277/9; 277/58

[58] Field of Search ..... 68/140, 208; 277/9, 277/58, 59; 384/484, 542

[56] References Cited

U.S. PATENT DOCUMENTS

| | | | |
|---|---|---|---|
| 1,562,019 | 11/1925 | Wilkinson | 277/58 X |
| 1,925,662 | 9/1933 | Hume | 68/140 |
| 2,636,754 | 4/1953 | Baudry | 277/58 X |
| 2,688,520 | 9/1954 | Covington | 277/59 X |
| 3,270,529 | 9/1966 | Engel | 68/140 X |
| 3,613,406 | 10/1971 | Toth | 68/140 |
| 3,854,732 | 12/1974 | Franz et al. | 277/58 |
| 4,448,425 | 5/1984 | von Bergen | 277/59 X |
| 4,835,993 | 6/1989 | Dreher | 68/142 X |

*Primary Examiner*—Philip R. Coe

*Attorney, Agent, or Firm*—Pearne, Gordon, McCoy & Granger

[57] ABSTRACT

A seal and bearing assembly for fabric treatment machines includes a bearing housing mounted on the machine shell providing a bearing journaling a rotatable shaft. A seal retainer is separately mounted on the shell inboard of the bearing housing and provides seals which normally prevent leakage along the shaft toward the bearing. The seal retainer and bearing housing are axially spaced and cooperate to define a drain chamber sufficiently large to prevent clogging by lint and the like. Release of the housing and movement thereof away from the shell provides access to the seal retainer for replacement of worn seals.

12 Claims, 4 Drawing Sheets

11
24
22
16
21
23
3
35
34
12
52
51
43
37
38
33
44
46
49
30
13
47
57
48
29
56
42
28
31
32
41
25
26
27
53
54
58
3

BEARING AND SEAL SYSTEM FOR FABRIC TREATMENT MACHINES

BACKGROUND OF THE INVENTION

This invention relates generally to fabric treatment machines, such as laundry and textile machines, and more particularly to a novel and improved bearing and seal assembly for a rotating shaft of such machines.

PRIOR ART

Many industrial, laundry and textile machines provide a rotating drum in which the textile materials are tumbled. The drum is contained within a shell and is usually supported by a rotating shaft, journaled in bearings mounted directly on the shell, or on a frame supporting the shell. During the washing or processing of the textile material, liquid is present within the shell and a seal system is provided to prevent such liquid from reaching the support bearings. When the seals wear or begin to leak for any reason, damage occurs if the liquid reaches the bearing. In many instances, this results in substantial repair and replacement expense.

In some instances, systems have provided two or more space seals ahead of the bearing with an intermediate drain. Such systems tend to reduce the occurrence of bearing damage by draining away the liquid leaking past the inboard seals before it reaches the bearing. The U.S. Pat. No. 3,270,529 issued to Engel, discloses such a system. In the system illustrated and described in such patent, a small gap is provided between the seals which opens to a drain chamber. A drain tube is connected to the drain chamber to convey the leakage out of the seal area. In theory, such system should operate to prevent liquid from reaching and damaging the bearing. However, in practice, the drain often fails to prevent bearing damage because the drain system becomes clogged with lint and other debris causing it to fail to function as an effective drain.

Further, in the system illustrated in such patent and in many other instances, the seals and bearings are mounted in a relatively complex expensive bearing housing. Generally, in the past, it has been necessary to inventory replacement housings with bearings and seals in order to permit prompt repair. This further increased the cost resulting from the bearing damage caused by seal leakage.

SUMMARY OF THE INVENTION

The present invention provides a novel and improved seal and bearing system which reduces and virtually eliminates the occurrence of bearing damage resulting from seal leakage. It also reduces the cost of the structural parts of the system. Further, replacement of leaking seals is more easily accomplished with the present invention, and the need to maintain expensive spare parts is substantially eliminated.

A bearing housing of the present invention can be produced with less machining operations resulting in reduced manufacturing expense. A separate structurally simple seal retainer or housing is provided for the upstream seals. A substantial spacing is provided for a large drain system that is substantially immune to clogging. Therefore, even when the upstream seals wear and commence to leak, the leakage is drained away, and the bearing is not damaged. Further, since the drain functions in a reliable manner, the machine operator, by observing the leakage, becomes aware of the seal deterioration and can make timely repairs by merely replacing the defective seal.

In the illustrated embodiment, a mounting ring for the bearing housing is welded to the back wall of the shell. A large drain opening is provided in the mounting ring by merely cutting away a broad notch or groove in the inner surface of the mounting ring. This groove cooperates with the adjacent side of the shell to define a large and effective drain passage. The illustrated bearing housing proper is a casting which is removably mounted on the face of the mounting ring by bolts. The rearward end of the bearing housing is closed by a removable end cap. A secondary seal is mounted in the forward face of the bearing housing to ensure that leakage entering the drain chamber does not reach the bearing. Such seal also functions to retain the bearing lubricant.

A seal retainer is also removably mounted on the machine shell and is substantially spaced from the bearing housing to provide a large drain chamber extending around the shaft and communicating with the drain passage formed in the mounting ring. The seal retainer is structurally simple and requires only a small amount of machining during its production. Mounted in the seal retainer are two lip seals which function in series to prevent the flow of liquid from the interior of the shell. A lubrication fitting is provided so that the zone between these two lip seals can be lubricated to reduce wear.

With the illustrated embodiment of this invention, a seal and bearing system is provided in which an intermediate drain functions reliably to prevent any leakage from reaching and damaging the bearings. The manufacturing costs are relatively low for this system, and the need for maintaining a spare parts inventory is substantially reduced.

These and other aspects of this invention are illustrated in the accompanying drawings and are more fully described in the following specification.

DETAILED DESCRIPTION OF THE DRAWINGS

Figure 1:
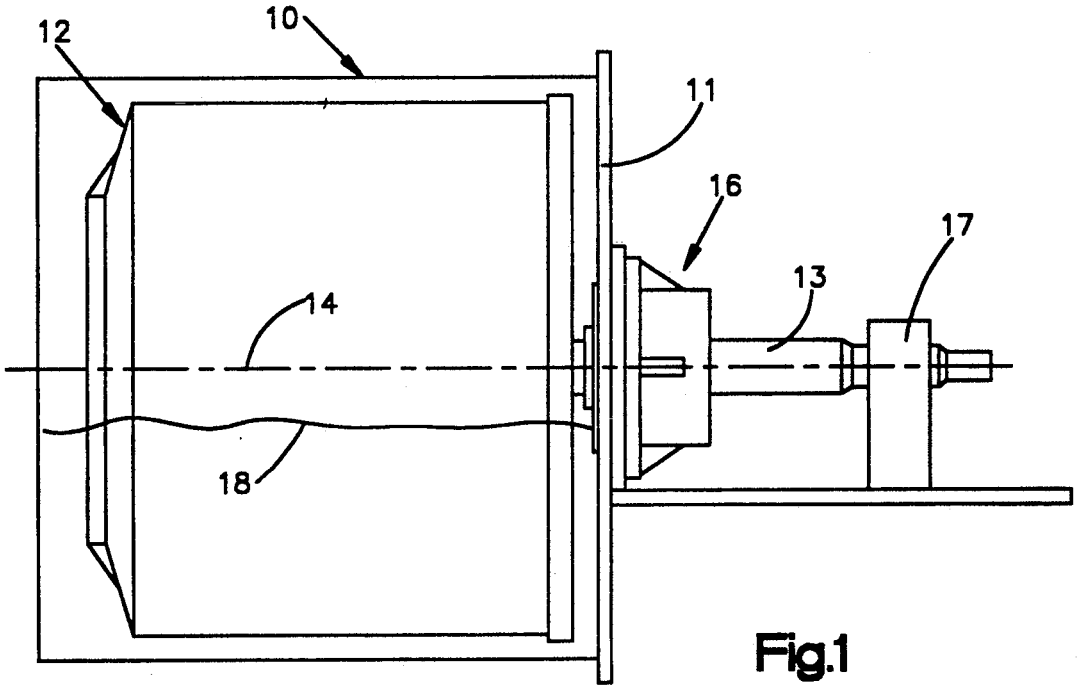
FIG. 1 schematically illustrates a typical textile machine with a bearing and seal assembly in accordance with the present invention mounted thereon.

FIG. 1 schematically illustrates a typical fabric treatment machine utilizing a seal and bearing assembly in accordance with the present invention. The machine includes a shell 10 having a back or rear shell head 11. Positioned within the shell is a tumbler drum 12 cantilever supported by a shaft 13 for rotation about an axis 14. The shaft 13 is journaled adjacent to the drum 12 in a seal and bearing assembly 16 mounted on the shell head 11 and is provided with an outboard bearing 17 spaced back from the seal and bearing assembly 16. A power drive (not illustrated) is connected to rotate the shaft and inturn the drum 12. During operation, fabric is positioned within the drum and water, chemicals or a dye bath schematically represented at 18 is supplied to the shell and functions to treat the fabric within the drum 12 as the shaft 13 rotates the drum. Such a machine is similar to the industrial washing machine described in the U.S. Pat. No. 4,835,993, assigned to the assignee of the present invention. Such patent may be referred to for a more detailed description of the typical machine of the type illustrated and described herein. Such patent is incorporated herein in its entirety to provide a more detailed description of a machine of the type to which this invention pertains.

Figure 2:
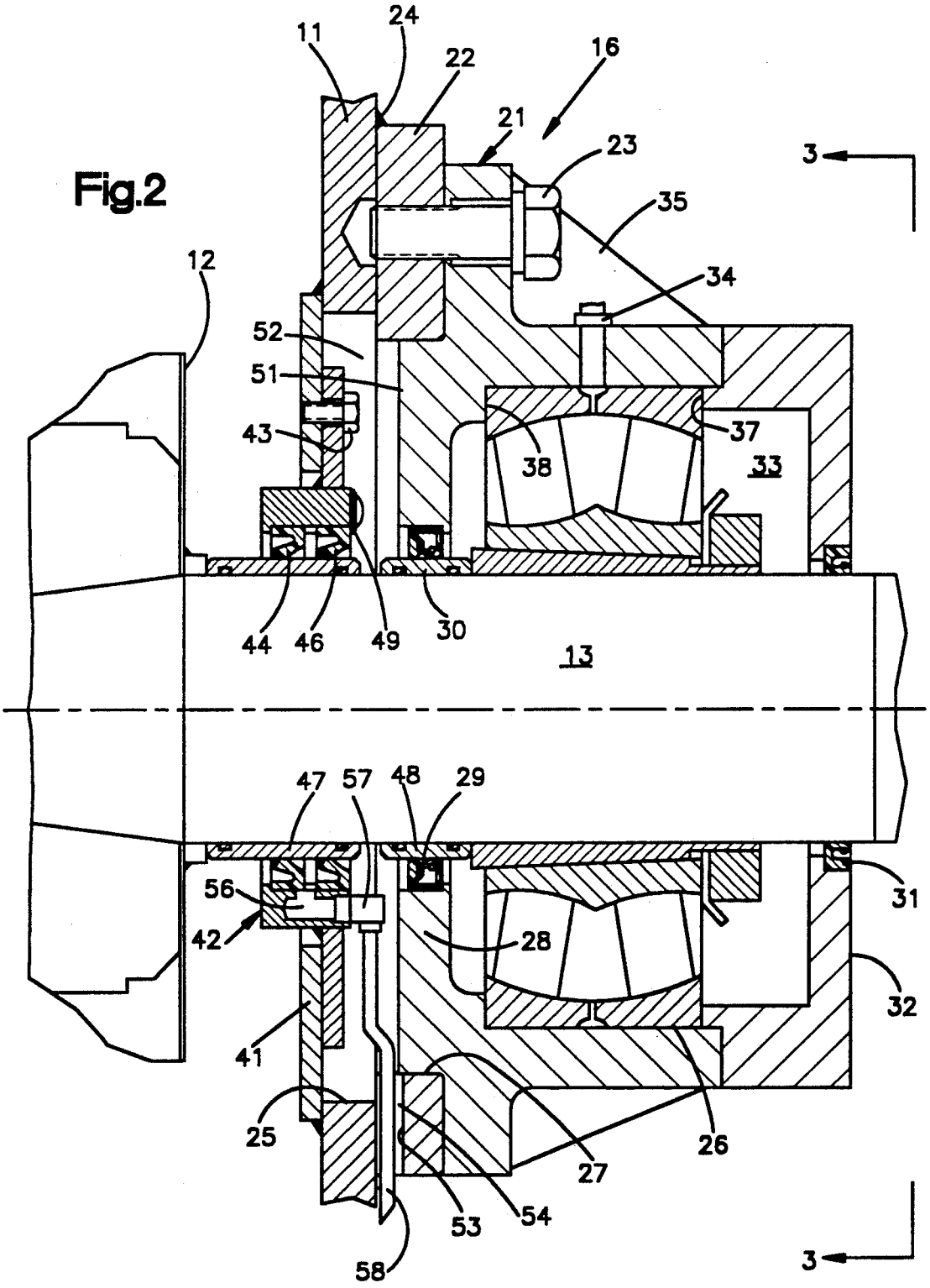
FIG. 2 is an enlarged cross-section of a preferred seal and bearing assembly incorporating the present invention.
Figure 3:
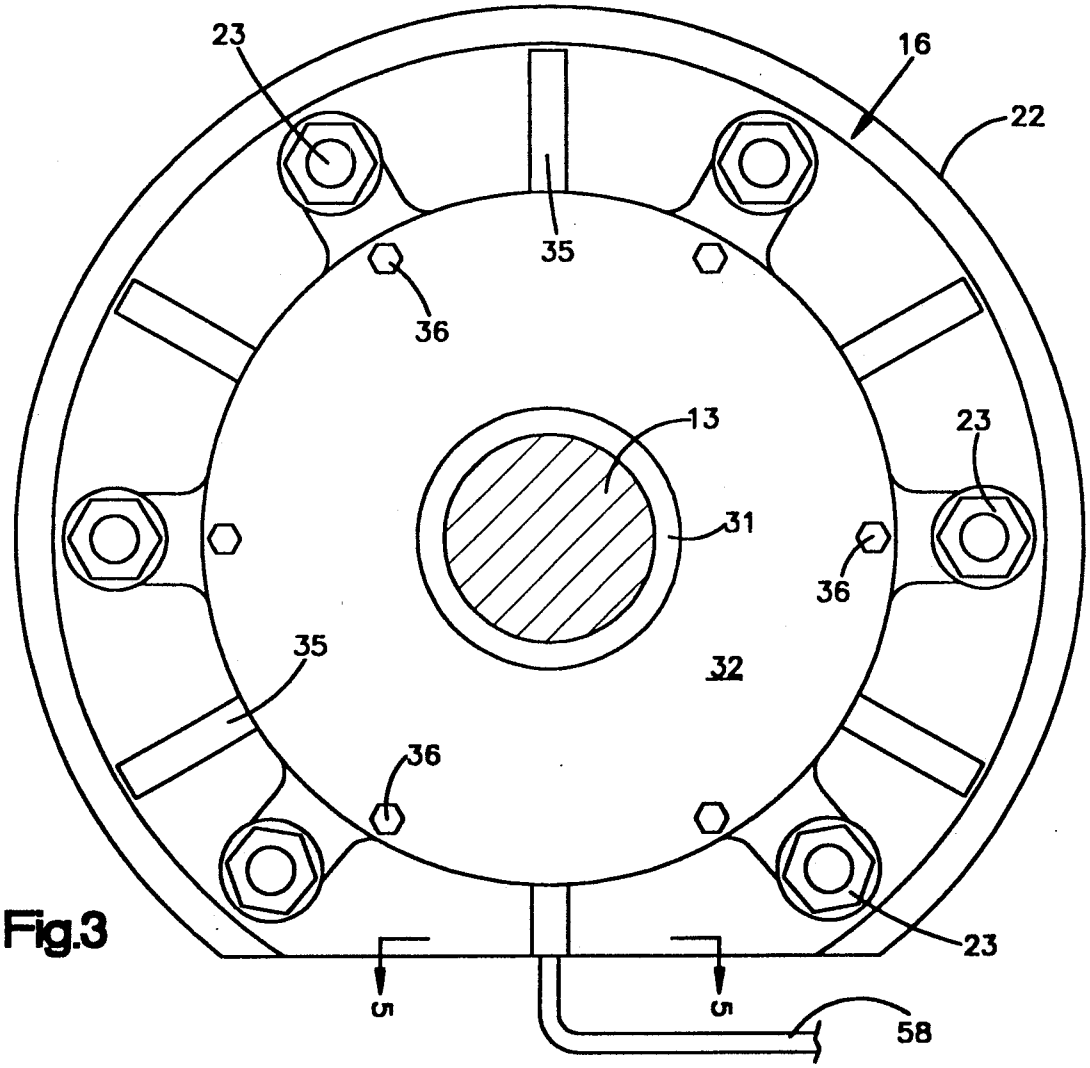
FIG. 3 is an end view taken along 3—3 of FIG. 2.
Figure 5:
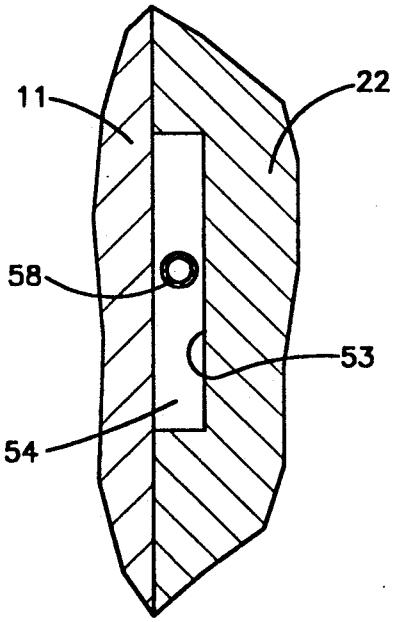
FIG. 5 is a fragmentary section taken along the 5—5 of FIG. 3, illustrating the drain passage provided in the mounting ring.

Referring to FIGS. 2 and 3, the seal and bearing assembly 16 includes a housing 21 mounted on a retainer ring 22 by a series of bolts 23. The retainer ring 22 is permanently secured to the shell head 11 by a weld 24 and extends around a shaft opening 25 formed in the shell head 11. Mounted in the housing 21 is an antifriction bearing 26 which supports and journals the shaft 13 for rotation about the axis 14. The housing is provided with a shoulder 27 which fits into the retainer or mounting ring 22 to provide radial support for the housing which is capable of withstanding the high radial loads applied to the bearing 26.

The housing is provided with an inwardly extending forward wall 28 which supports an inboard housing seal 29 which provides a dynamic seal with a sleeve 48 mounted on the shaft 13. The seal 29 cooperates with an outboard housing seal 31 mounted in a housing end cap 32 to define a bearing cavity 33 in which the bearing 26 is located. Bearing lubricant is applied to the bearing 26 through a fitting 34 and is confined in the bearing cavity 33 by the two seals 29 and 31. In the illustrated embodiment, the end cap 32 is removably mounted on the housing by bolts 36. The end cap 32 is provided with a shoulder 37 which cooperates with a shoulder 38 formed in the housing 21 to axially position the outer race of the bearing 26 within the housing assembly.

The illustrated housing is preferably formed of a casting having sufficient wall thickness and strength to support and position the bearing during normal operation of the machine. Fillets 35 stiffen the housing 21. However, such housing requires a relatively small amount of machining since it must merely contain the bearing 26 and the two seals 29 and 31.

A seal support ring 41 is welded to the inner surface of the shell head and provides the support for a seal retainer 42 which is removably mounted on the seal support ring 41 by bolts 43.

Mounted within the seal retainer are a pair of lip seals 44 and 46 which form a dynamic seal with a sleeve 47 mounted on the shaft 13 and operate in series to prevent liquid 18 within the shell from passing out of the shell along the shaft 13. The two lip seals are removably retained in the seal retainer 42 by a retainer ring 49.

The various elements are proportioned and sized so that a substantial spacing exists between the inner face 51 of the housing 21 and the seal retainer 42, so that they cooperate to provide a relatively large drain chamber 52, extending around the shaft between the seals 46 and 29. The lower portion of the retainer ring 22 is formed with a large notch or groove 53 which cooperates with the adjacent portion of the shell head 11 to form a drain passage 54 communicating with a lower end of the drain chamber 52. The drain chamber 52 and the drain passage 54 are of sufficient size so that they do not become clogged with lint and other debris and function reliably to drain away any leakage past the two seals 44 and 46. In fact, in the illustrated embodiment, the notch is sufficiently large to provide a drain passage having a cross-section of about one-half inch by three inches.

In order to provide lubricant to the two lip seals 44 and 46, the seal retainer 42 is provided with a lubricant passage 56 open to the zone between the two seals 44 and 46 and communicating with a fitting 57. The fitting 57 connects the lubricant passage 56 with a lubrication tube 58 extending down through the drain passage 54 to an external location accessible to the machine operator. This permits the periodic lubrication of the seals 44 and 46 to extend their useful life.

In normal operation, prior to wear of the two seals 44 and 46, they provide a fluid-tight dynamic seal with the seal sleeve 47 and prevent any leakage of liquid out of the shell along the shaft 13. However, when wear occurs, leakage exists past the two seals 44 and 46 into the drain chamber 52. Since this drain chamber is large, it does not become clogged and the leakage passes down along the drain chamber 52 to the drain passage 54 and out of the housing. Since pressure cannot build up within the drain chamber 52, the leakage does not pass the seal 29 into the bearing cavity 33 and does not damage the bearing 26.

The operation of the drain is sufficiently reliable to allow continued operation of the system until maintenance can be performed. Further, the presence of leakage below the drain passage 54 indicates to the machine operator that seal wear has occurred and that replacement of the two seals 44 and 46 should be done.

Figure 4:
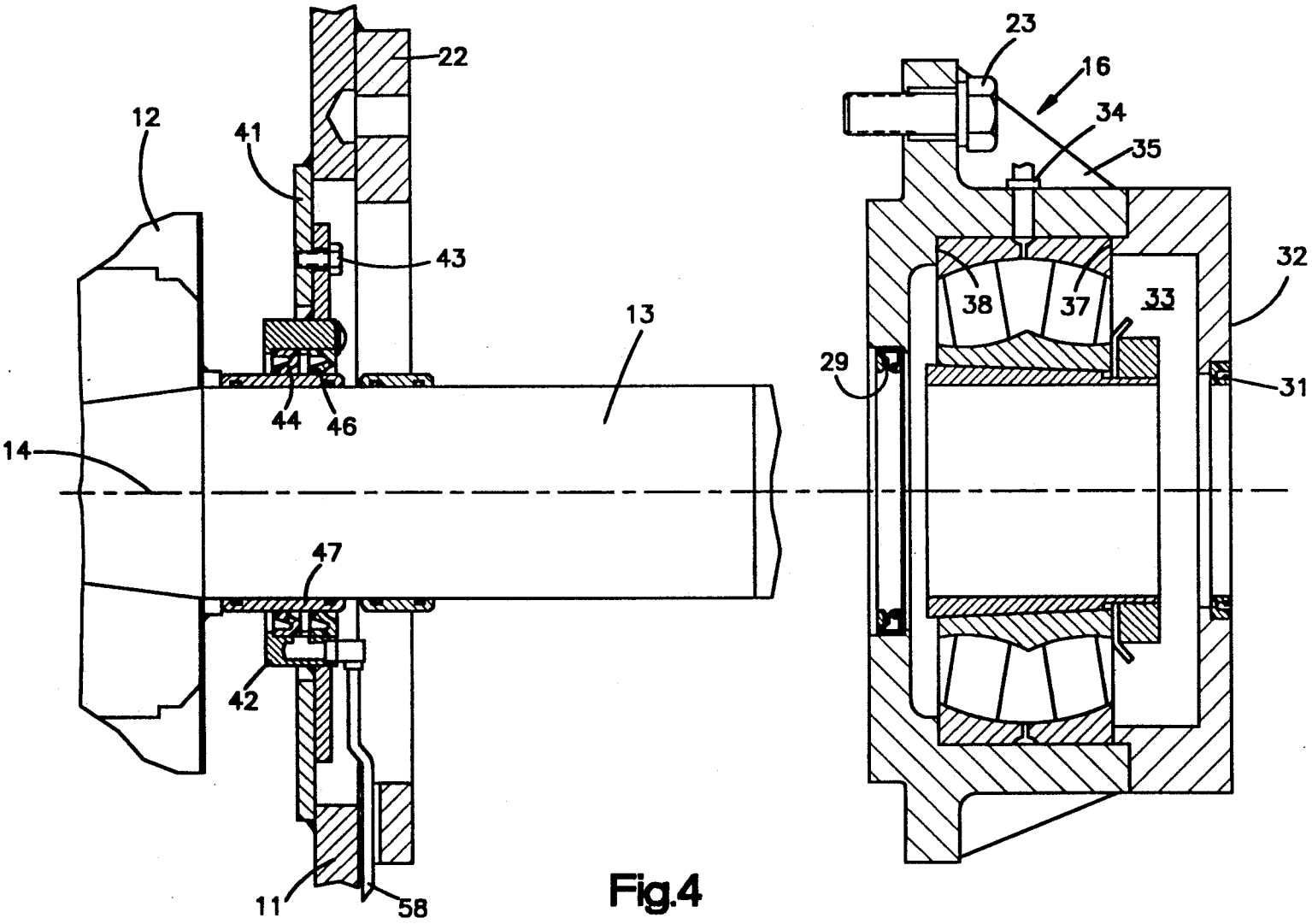
FIG. 4 is an exploded view of the seal and bearing system illustrated in FIG. 2, illustrating the manner in which seal replacement may be performed.

When service is required, the bolts 23 are removed so that the housing 21 and the end cap 32 can be moved axially along the shaft away from the retainer ring 22, as illustrated in FIG. 4. This provides access to the seal retainer 42, permitting removal of the bolts 43, and access to the fitting 57, so that the tube can be removed from the fitting if it is desired to move the seal retainer 42 back along the shaft for replacement of the seals 44 and 46. However, removal of the seal retainer 42 is not required in all instances, and the worn seals can be removed and replaced by replacement seals, in many instances, without removing the seal retainer.

Preferably, the lip seals 44 and 46 are formed as split rings so that they do not have to be assembled over the end of the shaft. However, in instances in which the seals 44 and 46 are not split seals, they must be assembled over the end of the shaft and moved into the installed position during the repair operation.

With this invention, a reliable drain system is provided which virtually eliminates damage to the bearing 26 caused by seal leakage. Consequently, the cost of maintaining the machine for normal operation is substantially reduced. Further, since a simple structure is provided for mounting the inboard lip seals 44 and 46, and for the bearing housing 21, reduced costs are achieved during manufacture. Further, since bearing failure is avoided in most instances, it is not necessary to maintain an inventory of spare housings and/or bearings.

Although a preferred embodiment of this invention has been shown and described, it should be understood that various modifications and rearrangements of the parts may be resorted to without departing from the scope of the invention as disclosed and claimed herein.

What is claimed is:

1. A fabric treatment machine comprising a shell having a wall defining a shell interior for containing fabric treatment liquid, a rotatable shaft extending through said wall into said interior, a bearing housing, fastening means accessible exteriorly of said shell releasably mounting said bearing housing on said wall, a bearing mounted in said bearing housing journaling said shaft, a seal retainer mounted on said wall at a location inwardly spaced from said bearing housing providing seal means normally preventing leakage of liquid along said shaft, said seal retainer and bearing housing cooperating to define a drain chamber extending around said shaft, and a drain passage connected to drain liquid from said chamber, release of said fastening means from the exterior of said shell permitting movement of said bearing housing along said shaft to provide access to said seal retainer for replacement of worn seals, said drain chamber and drain passage having sufficient size to prevent clogging by lint and debris.

2. A machine as set forth in claim 1, wherein said bearing housing is provided with a shaft seal between said drain chamber and said bearing preventing liquid leakage from entering said bearing.

3. A machine as set forth in claim 2, wherein said seal means includes two seals engaging said shaft at axially spaced locations, and lubrication means are connected to supply lubricant between said two seals.

4. A machine as set forth in claim 3, wherein a portion of said lubrication means extends through said drain passage.

5. A machine as set forth in claim 1, wherein said seal retainer is removably mounted on said wall and is removable therefrom after said bearing housing is moved axially along said shaft away from said wall.

6. A machine as set forth in claim 1, wherein said wall includes a mounting ring on which said bearing housing is releasably mounted.

7. A machine as set forth in claim 6, wherein said drain passage is formed in said mounting ring.

8. A machine as set forth in claim 6, wherein said retainer ring is welded to the exterior surface of the adjacent wall, and an inner ring is welded to the inner surface of the adjacent wall, said seal mounting being removably mounted on said inner ring.

9. A machine as set forth in claim 1, wherein a drum in said interior of said shell is mounted on said shaft.

10. A fabric treatment machine comprising a shell defining a treatment chamber and having a shell head having inner and outer surfaces and providing a shaft opening, a tumbler drum in said treatment chamber for tumbling loads of fabric, a mounting ring mounted on the outer surface of said shell head around said shaft opening, a seal support ring mounted on the inner surface of said shell head around said shaft opening, a bearing housing, fastening means accessible externally of said shell removably mounted mounting said bearing housing on said mounting ring, said bearing housing providing a bearing, a shaft journaled in said bearing connected to said tumbler drum, a seal retainer mounted on said seal support ring providing seal means sealing with said shaft to prevent liquid from leaking along said shaft to said bearing, said seal retainer and said bearing housing being spaced along said shaft and cooperating to define a drain chamber for discharging liquid leakage past said seal means before said leakage reaches said bearing, release of said fastener means from the exterior of said shell permitting movement of said bearing housing along said shaft to provide access to said seal retainer for replacement of worn seals.

11. A machine as set forth in claim 10, wherein a notch is formed in said mounting ring which cooperates with said shell head to define a drain passage open to said drain chamber.

12. A machine as set forth in claim 10, wherein release of said bearing housing from said mounting ring permits movement of said bearing housing away from said retainer ring and providing access to said seal retainer for replacement of worn seals.

* * * * *